US006967621B1

(12) United States Patent
Cadotte, Jr. et al.

(10) Patent No.: US 6,967,621 B1
(45) Date of Patent: Nov. 22, 2005

(54) SMALL LOW PROFILE ANTENNAS USING HIGH IMPEDANCE SURFACES AND HIGH PERMEABILITY, HIGH PERMITTIVITY MATERIALS

(75) Inventors: Roland Cadotte, Jr., Freehold, NJ (US); William D. Wilber, Southbury, CT (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 2 days.

(21) Appl. No.: 10/808,035

(22) Filed: Mar. 16, 2004

(51) Int. Cl.[7] ..... H01Q 1/38
(52) U.S. Cl. ..... 343/700 MS; 343/787; 343/846
(58) Field of Search ..... 343/700 MS, 846, 343/848, 787, 909

(56) References Cited

U.S. PATENT DOCUMENTS 5,327,148 A 7/1994 How et al.
6,175,337 B1 * 1/2001 Jasper et al. ..... 343/770
6,285,325 B1 9/2001 Nalbandian et al.
6,369,760 B1 4/2002 Nalbandian et al.
6,392,600 B1 * 5/2002 Carson et al. ..... 343/700 MS
6,483,481 B1 * 11/2002 Sievenpiper et al. ..... 343/909
6,525,691 B2 * 2/2003 Varadan et al. ..... 343/700 MS
6,670,932 B1 * 12/2003 Diaz et al. ..... 343/909

OTHER PUBLICATIONS

Sievenpipper, Daniel Frederic, "High-impedance electromagnetic Surfaces", Dissertation for the degree of Doctor of Philosophy in Electrical Engineering, University of California, Los Angeles, 1999.

* cited by examiner

*Primary Examiner*—Tan Ho
(74) *Attorney, Agent, or Firm*—Michael Zelenka; Roger C. Phillips

(57) ABSTRACT

A low profile antenna includes an antenna and a ground plane structure operatively associated with the antenna. The ground plane structure has a generally planar surface, at least one protrusion extending from the planar surface and a dielectric substrate supported by the planar surface. The dielectric substrate includes a relative permeability ($\mu$) of greater than or equal to about one and a relative permittivity ($\epsilon$) of greater than or equal to about one.

9 Claims, 2 Drawing Sheets

SMALL LOW PROFILE ANTENNAS USING HIGH IMPEDANCE SURFACES AND HIGH PERMEABILITY, HIGH PERMITTIVITY MATERIALS

GOVERNMENT INTEREST

The invention described herein may be manufactured, used, imported, sold, and licensed by or for the Government of the United States of America without the payment of any royalty thereon or therefor.

BACKGROUND OF THE INVENTION

1. Field of the Invention

The present invention relates generally to antennas and, more particularly, to antennas which have a low profile.

2. Related Art

Low profile antennas are known. For example, U.S. Pat. No. 5,327,148 to How et al describes a microstrip antenna that has a substrate that includes a ground plane conductor disposed over a first surface and a strip conductor disposed over a second surface. A DC magnetic field biasing circuit provides a directed DC magnetic field to the substrate such that the strip conductor radiates electromagnetic energy that has a circular polarization. In one particular embodiment, the substrate is composed of magnesium ferrite and in another, a second substrate of ferrite material is disposed over the strip conductor to reduce the radar cross section of the antenna.

The antenna, described by How et al, suffers from the drawback that a significant fraction of energy is dissipated in surface waves because of the limited size of the ground plane.

An effort was made to overcome the foregoing drawback by Daniel Frederic Sievenpiper in his Ph.D. thesis entitled "High-Impedance Electromagnetic Surfaces", University of California, Los Angeles, 1999 (below referred to as "Sievenpiper"). Sievenpiper describes providing a high impedance surface which reduces surface waves and which consists of a plurality of metal protrusions on a flat metal sheet. The metal protrusions include flat metal plates disposed on vertical posts. Each of the metal plates and posts function to provide a capacitance and an inductance and as such function as electric filters to block the flow of surface waves.

One disadvantage that arises in connection with an antenna employing a relatively high impedance electromagnetic ground plane surface, such as that described by Sievenpiper, is that an associated narrow bandwidth of approximately 8% occurs when transmitting at microwave frequencies. Accordingly, it is desired to provide a low profile antenna that is both efficient and that does not compromise bandwidth.

SUMMARY OF THE INVENTION

In accordance with an embodiment of the present invention, a low profile antenna comprises an antenna and a ground plane structure operatively associated with the antenna. The ground plane structure comprises a generally planar surface, at least one protrusion extending from the planar surface and a dielectric substrate supported by the planar surface. The dielectric substrate comprises a relative permeability ($\mu$) of greater than or equal to about one and a relative permittivity ($\epsilon$) of greater than or equal to about one.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a low profile antenna that is both efficient and that is capable of transmitting a signal with an increased bandwidth. The low profile antenna comprises an antenna and a high impedance ground plane structure that functions to reduce surface waves while not compromising bandwidth. Also, the low profile antenna may be configured for use at relatively low microwave frequencies without incurring unsuitably large dimensional requirements.

Figure 1:
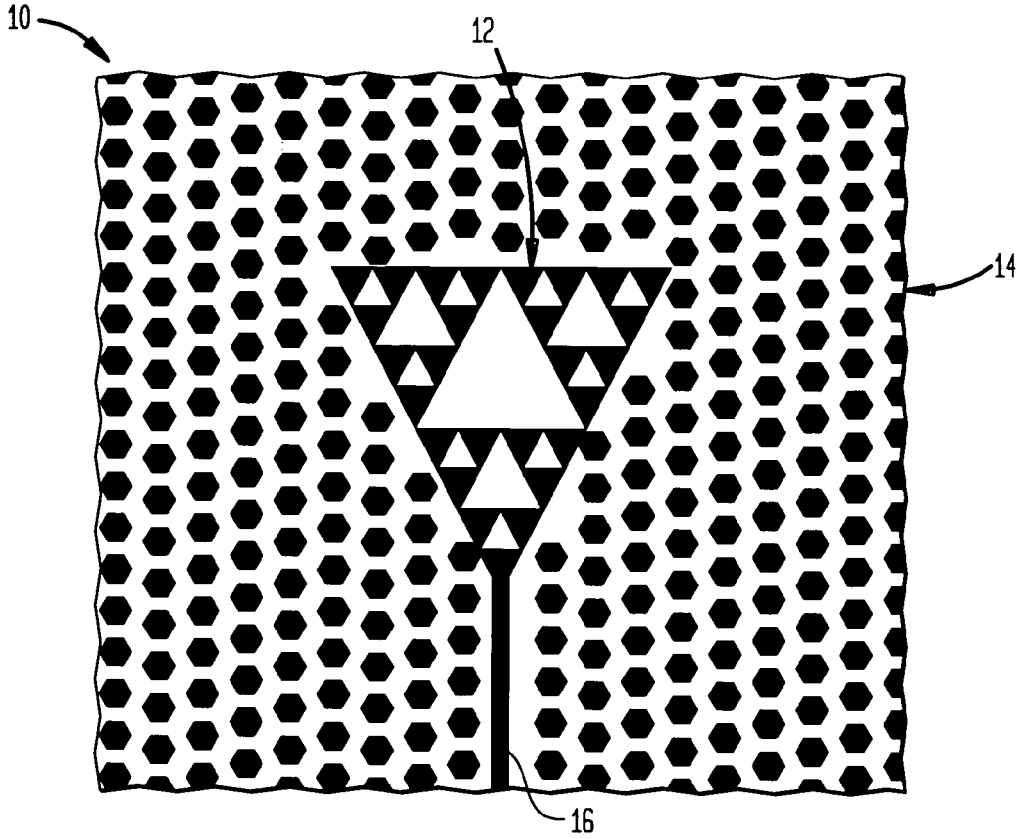
FIG. 1 is a diagram showing a portion of a low profile antenna in accordance with one embodiment of the present invention.

Referring now to FIG. 1, a low profile antenna in accordance with one embodiment of the present invention is illustrated generally at 10. In this embodiment, the low profile antenna 10 comprises an antenna 12 and a ground plane structure 14.

The antenna 12 preferably comprises a known fractal, microstrip antenna, although, it will be understood that any suitably low profile antenna may be employed in the practice of the present invention. The antenna 12 is illustrated as having a generally triangular outer configuration and may comprise a Sierpinski triangle which is connected by an input feed line 16. Further details of antennas suitable for use in this embodiment of the present invention may be found in U.S. Pat. No. 6,285,325 to Nalbandian et al, U.S. Pat. No. 6,369,760 to Nalbandian et al and U.S. Pat. No. 6,525,691 to Varadan et al, each of which is incorporated herein by reference to the extent necessary to make and practice the present invention.

Figure 2:
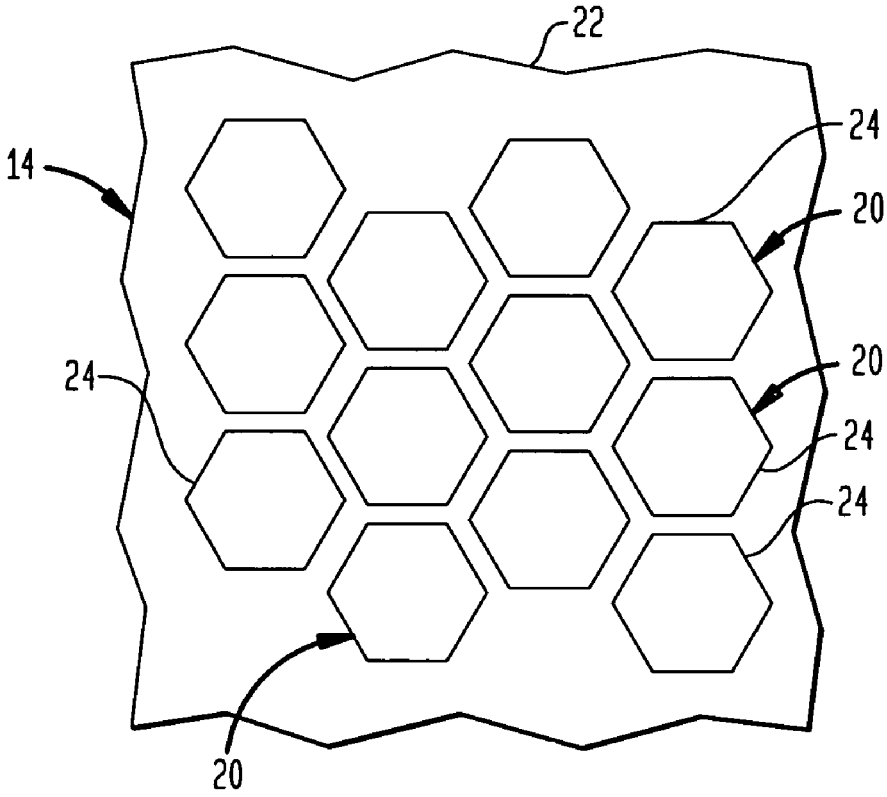
FIG. 2 is a diagram showing an enlarged portion of the low profile antenna of FIG. 1 that includes a portion of a high impedance ground plane structure.
Figure 3:
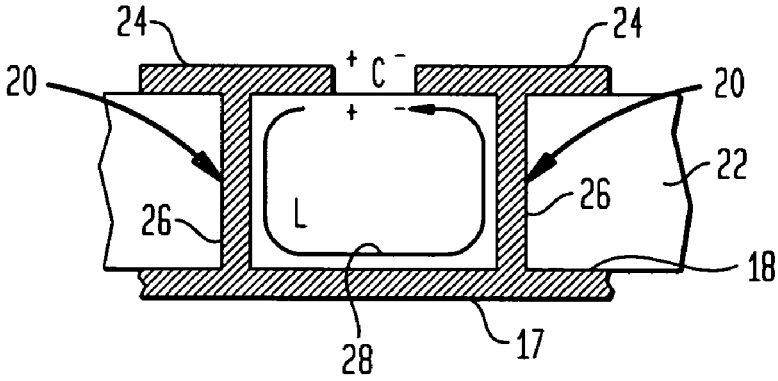
FIG. 3 is a diagram showing a portion of the ground plane structure of FIG. 2 that includes a pair of pedestals and posts connected to a planar surface that surrounds a substrate.

In accordance with a feature of the present embodiment and referring now to FIGS. 2 and 3, the ground plane structure 14 may comprise a plate 17 having a generally planar surface 18, protrusions 20 and a substrate 22. Depending upon the desired frequency and required dimension, the ground plane structure 14 may be fabricated using known techniques such as by photolithography including chemical vapor deposition processes or the like and/or discreet component formation and assembly.

The plate 17 may comprise a metallic substance, in particular, compositions including, e.g., copper (Cu), silver (Ag), gold (Au), aluminum (Al) and tin (Sn), and mixtures thereof. The planar surface 18, together with the protrusions 20, may function as a high impedance ground plane for the antenna 12 (FIG. 1). The protrusions 20 may also be composed of a metallic substance, similar to that of the plate 17, and may comprise pedestals 24 and posts 26.

The pedestals 24 and posts 26 may function as a filter circuit to reduce surface waves traveling along the ground plane structure 14. As represented by arrow 28, a pair of posts 26, plate 17 and portions of the pedestals 24 may be combined to provide an inductance (L), between each pedestal 24, a capacitance (C) is created. Accordingly, it will be appreciated that the particular dimensions of the pedestals 24 and posts 26 may be varied based on the particular frequency of the signal transmitted from the antenna.

The pedestals 24 are illustrated as having a hexagonal outer configuration which provides for a suitable amount of capacitance, although, it will be appreciated that other configurations, such as square, rectangular, circular and triangular may be employed depending upon, e.g., the frequency of a signal transmitted from the antenna 12. In one particular embodiment, the pedestals 24 and posts 26 may be fabricated together as a component such as a rivet.

The posts 26 may be circular or square in cross section, although, any suitable configuration may be employed. For example, where the ground plane structure 14 is fabricated using photolithography, the posts 26 may be configured similar to a via formed in a printed circuit board.

In accordance with another feature of this embodiment, the substrate 22 comprises a material having a large relative permeability ($\mu$) and a large relative permittivity ($\epsilon$), which functions to reduce the dimensional requirements of an antenna, for a given frequency, by a factor of $((\mu)(\epsilon))^{1/2}$. That is in addition to providing an increase in bandwidth over a prior art high impedance ground plane surface structure such as that described by Sievenpiper above. It will be appreciated that the bandwidth of an antenna is proportional to $(\mu/\epsilon)^{1/2}$ since the functional bandwidth of an antenna using a high-impedance surface is approximately equal to the impedance of that surface divided by the impedance of free space ($Z_0/\eta$) (see Sievenpiper above) where the impedance of the high-impedance surface is equal to the square root of the inductance divided by the capacitance or $(L/C)^{1/2}$, and the inductance is dependent on the relative permeability ($\mu$) of the substrate and the capacitance is dependent on the relative permittivity ($\epsilon$) of the substrate.

The substrate 22 is illustrated as extending between the pedestals 24 and planar surface 18 of the plate 17, although, it may also extend between the ground plane structure 14 and the antenna 12. The substrate 22 may comprise a relative permeability ($\mu$) that is greater than or equal to approximately one but is more preferably in the range of from approximately one to approximately one hundred. Similarly, the substrate 22 may comprise a relative permittivity ($\epsilon$) that is greater than or equal approximately one but is more preferably in the range of from approximately one to approximately one hundred. Particularly suitable materials include ferrimagnetic materials such as magnesium ferrite (designation No. 103-67 and available from Trans-Tech, Inc. of Adamstown, Md.) that includes a relative permeability of 30 (measured at 1 kHz) and a relative permittivity of 11.8 (measured at 9.4 GHz). The impedance level for this material, which is proportional to the formula $(\mu/\epsilon)^{1/2}$, was found to be 1.68. Accordingly, the ground plane structure 14 provides an enhanced signal bandwidth while also providing an increase in efficiency.

One less preferable material for the substrate 22 is a circuit board composition no. 5880 manufactured by the Rogers Corporation of Chandler, Ariz., that has a relative permeability of one and a relative permittivity of about four. The antenna 12 when used with a ground plane structure 14 having a substrate 22 employing Rogers' circuit board composition, provides a bandwidth which was approximately 2.4 times less than that of the magnesium ferrite material available from Trans-Tech, Inc.

While the present invention has been described in connection with what is presently considered to be the most practical and preferred embodiment, it is to be understood that the present invention is not limited to the herein disclosed embodiment. Rather, the present invention is intended to cover all of the various modifications and equivalent arrangements included within the spirit and scope of the appended claims.

What is claimed is:

1. A low profile antenna, comprising:

A fractal pattern antenna being generally planar in configuration and extending in a first direction; and a ground plane structure operatively associated with the antenna, the ground plane structure comprising:

a generally planar surface that extends in a direction that is generally parallel to the first direction;

at least one protrusion extending from the planar surface; and a dielectric substrate supported by the planar surface, the dielectric substrate comprising a ferrimagnetic material that has a relative permeability ($\mu$) of greater than or equal to about one and a relative permittivity ($\epsilon$) of greater than or equal to about one.

2. The antenna of claim 1, wherein the at least one protrusion comprises:

a plurality of pedestals; and a plurality of posts interconnecting each of the pedestals and the planar surface;

wherein the dielectric substrate extends between the planar surface and the pedestals.

3. The antenna of claim 2, wherein:

the plurality of pedestals are disposed about the antenna;

the antenna extends in a direction that is generally parallel to that of the planar surface; and the dielectric substrate further extends between the antenna and the planar surface.

4. The antenna of claim 3, wherein each of the pedestals comprise a generally hexagonal outer configuration.

5. The antenna of claim 4 wherein the antenna comprises a generally triangular outer configuration.

6. The antenna of claim 1, wherein a thickness of the dielectric substrate is less than one-half wavelength of a signal input to the antenna.

7. The antenna of claim 1, wherein the dielectric substrate comprises a permeability ($\mu$) that is in the range of between about one and about one hundred.

8. The antenna of claim 1, wherein the dielectric substrate comprises a permittivity ($\epsilon$) that is in the range of between about one and about one hundred.

9. The antenna of claim 1, wherein the ferrimagnetic material comprises magnesium ferrite.

* * * * *